US009474428B2

(12) United States Patent
Sampaio

(10) Patent No.: US 9,474,428 B2
(45) Date of Patent: Oct. 25, 2016

(54) UPRIGHT SWEEP SET

(71) Applicant: Casabella Holdings, LLC, Congers, NY (US)

(72) Inventor: Andre Sampaio, Valley Cottage, NY (US)

(73) Assignee: Casabella Holdings, LLC, Congers, NY (US)

( * ) Notice: Subject to any disclaimer, the term of this patent is extended or adjusted under 35 U.S.C. 154(b) by 0 days.

(21) Appl. No.: 14/524,048

(22) Filed: Oct. 27, 2014

(65) Prior Publication Data

US 2016/0113382 A1 Apr. 28, 2016

(51) Int. Cl.

| | |
|---|---|
| ***A47L 13/52*** | (2006.01) |
| ***A47L 5/00*** | (2006.01) |
| ***A46B 5/00*** | (2006.01) |
| ***A46B 17/08*** | (2006.01) |

(52) U.S. Cl.

CPC ..... *A47L 13/52* (2013.01); *A46B 5/0095* (2013.01); *A46B 17/08* (2013.01); *A46B 2200/302* (2013.01)

(58) Field of Classification Search

CPC ..... A47L 13/52; A46B 5/00; A46B 5/0095; A46B 7/04; A46B 7/042; A46B 7/044; A46B 2200/302

USPC ..... 15/145, 176.1, 176.6, 257.1–257.9; D4/116, 130, 132, 135; D32/50, 74

See application file for complete search history.

(56) References Cited

U.S. PATENT DOCUMENTS 145,792 A * 12/1873 Forsyth, Jr. ..... A47L 13/52 15/257.8
360,643 A 4/1887 Austin
1,555,630 A 9/1925 Brock
2,701,379 A * 2/1955 Balistreri ..... B25G 1/00 15/143.1
2,816,305 A 12/1957 Kravitt
3,407,424 A * 10/1968 Lanzarone ..... A47L 13/24 15/121
4,802,258 A * 2/1989 Jensen ..... A47L 13/52 141/108
5,343,589 A * 9/1994 Davenport ..... A47L 13/52 15/257.4
5,379,481 A * 1/1995 DeMars ..... A47L 13/52 15/257.2
5,425,153 A * 6/1995 Vosbikian ..... A47L 13/52 15/257.2
D359,853 S * 7/1995 Haug ..... D4/129
5,473,790 A * 12/1995 Desmarais ..... A47L 13/52 15/257.7
5,517,710 A 5/1996 Hisey
5,809,604 A * 9/1998 Olstyn ..... B25G 3/06 15/111
5,839,145 A 11/1998 Petner (Continued)

FOREIGN PATENT DOCUMENTS

CA 2443397 * 7/2003
DE 3229054 * 2/1984

(Continued)

*Primary Examiner* — Mark Spisich
(74) *Attorney, Agent, or Firm* — Curtis, Mallet-Prevost, Colt & Mosle, LLP

(57) ABSTRACT

An Upright Sweep Set is disclosed where an upright dustpan with a handle and retention claw arrangement serves to retain a broom or another cleaning device. The upright dustpan can be used without bending over, and folds up for storage or to retain debris that have been collected. The broom has a retention collar to allow the retention claw of the upright dustpan to grip the broom with the dustpan in either the open or the closed position. Both the upright dustpan and the broom have removable handles that are retained with a live hinge tab and receiver to allow the broom to also be used as a whisk broom and to allow the upright dustpan to be used either with or without a handle.

15 Claims, 11 Drawing Sheets

(56) References Cited

U.S. PATENT DOCUMENTS

| | | | | |
|---|---|---|---|---|
| 6,023,812 | A * | 2/2000 | Morad | A47L 13/52 15/257.1 |
| D433,571 | S | 11/2000 | Ancona | |
| D468,106 | S | 1/2003 | Robertson | |
| 6,854,919 | B2 * | 2/2005 | Neumann | B25G 1/04 15/145 |
| 6,971,138 | B2 | 12/2005 | Berti | |
| 7,000,281 | B1 | 2/2006 | Morad | |
| D521,201 | S | 5/2006 | Iacchetti | |
| D587,417 | S * | 2/2009 | Sartori | D4/135 |
| 7,895,696 | B2 | 3/2011 | Belmonte | |
| 8,087,514 | B1 | 1/2012 | Fulford | |
| 2006/0230560 | A1 | 10/2006 | Sampaio | |
| 2007/0089259 | A1 | 4/2007 | Jones | |
| 2007/0163069 | A1 * | 7/2007 | Sampaio | A47L 13/52 15/257.7 |
| 2009/0211045 | A1 * | 8/2009 | Michelson | B25G 1/04 15/143.1 |
| 2009/0223007 | A1 | 9/2009 | Li | |

FOREIGN PATENT DOCUMENTS

| | | | |
|---|---|---|---|
| FR | 2063819 | * | 7/1971 |
| GB | 2168599 | * | 6/1986 |
| JP | 2001-198069 | * | 7/2001 |
| JP | 2002-238824 | * | 8/2002 |
| JP | 2005-245665 | * | 9/2005 |

* cited by examiner

UPRIGHT SWEEP SET

BACKGROUND OF THE INVENTION

1. Field of the Invention

This invention relates generally to cleaning devices, and more specifically to an upright sweep set comprising a novel broom and upright dustpan.

2. Description of Related Art

Brooms are common cleaning devices that have been used for hundreds if not thousands of years. Bundles of natural material such as twigs, grass, and corn husks were used in ancient times to clean floors and hearth areas. A popular material used in the construction of this cleaning device was branches of broom, a yellow flowering shrub. As civilization advanced, broom making became a skilled trade with artisans known as "besom squires" in Anglo-Saxon England. Besom being the name for a cleaning tool made from a bundle of sticks or twigs used to whisk dirt away.

In the United States, a species of *Sorghum* known as broomcorn became the standard material for brooms in the northeastern United States, and an industry was born. The Shakers, a Christian religious sect that excelled at handicrafts, perfected various broom styles including the flat broom and the whisk broom.

With modern day materials such as plastics, many brooms are now made entirely from plastic, although there still remains a thriving demand for natural fiber brooms. Whether natural fibers or plastic, brooms typically are made with a handle to allow the user to operate the broom without bending over. There are also, however, specialized brooms such as whisk brooms or dusters that do not have handles, and are used to remove dirt and other unwanted materials from small areas or objects such as tables, clothing, a small area of a floor, and the like. There are also times when a broom with a handle is needed for a particular cleaning job as well as a whisk broom. Regardless of the style of broom, once a cleaning job is complete, the debris that have been swept into a pile must now be removed. Commonly, a dustpan is used to collect the debris and move them to a suitable place for disposal. Dustpans typically have a short handle and a tray, and are stored separately from the broom itself. Further, most dustpans require the user to bend over to pick up the debris from the sweeping operation. While at times it is desirable to bend over to collect the swept up debris, there are many occasions where constant bending over can be nothing more than a pain in the back.

What is needed is a handled broom that can also be used as a whisk broom. What is also needed is a dustpan that can be used with or without a handle to alleviate bending over. What is also needed is a broom and upright dustpan combination that can be stored with the upright dustpan in a folded but still stable position with the broom attached therewith.

It is thus an object of the present invention to provide an upright sweep set comprising a novel broom and dustpan. It is another object of the present invention to provide an upright sweep set with a detachable broom handle to allow the broom to be used with or without the handle. It is another object of the present invention to provide an upright sweep set that can be stored together. It is yet another object of the present invention to provide an upright sweep set where the dustpan has a handle that retains the broom in an upright position without the bristles becoming deformed. It is another object of the present invention to provide an upright sweep set where the dustpan folds to facilitate storage. It is yet another object of the present invention to provide an upright sweep set where the broom may be retained by the dustpan handle with the dustpan in either an open or closed position.

These and other objects of the present invention are not to be considered comprehensive or exhaustive, but rather, exemplary of objects that may be ascertained after reading this specification and claims with the accompanying drawings.

BRIEF SUMMARY OF THE INVENTION

In accordance with the present invention, there is provided an upright sweep set comprising a broom comprising a cleaning head with a top side and a bottom side, the top side comprising a cleaning head coupling with a live hinge tab receiver and the bottom side comprising bristles; a broom handle comprising a retention collar, at least one grip, and a live hinge tab for removably coupling the broom handle to the cleaning head; and an upright dustpan comprising a handle having a retention claw for removably attaching to the retention collar of the broom, and a handle coupling with a live hinge tab receiver for removably coupling the handle to a dustpan that has a live hinge tab.

The foregoing paragraph has been provided by way of introduction, and is not intended to limit the scope of the invention as described in this specification, claims and the attached drawings.

BRIEF DESCRIPTION OF THE DRAWINGS

The invention will be described by reference to the following drawings, in which like numerals refer to like elements, and in which.

Figure 1:
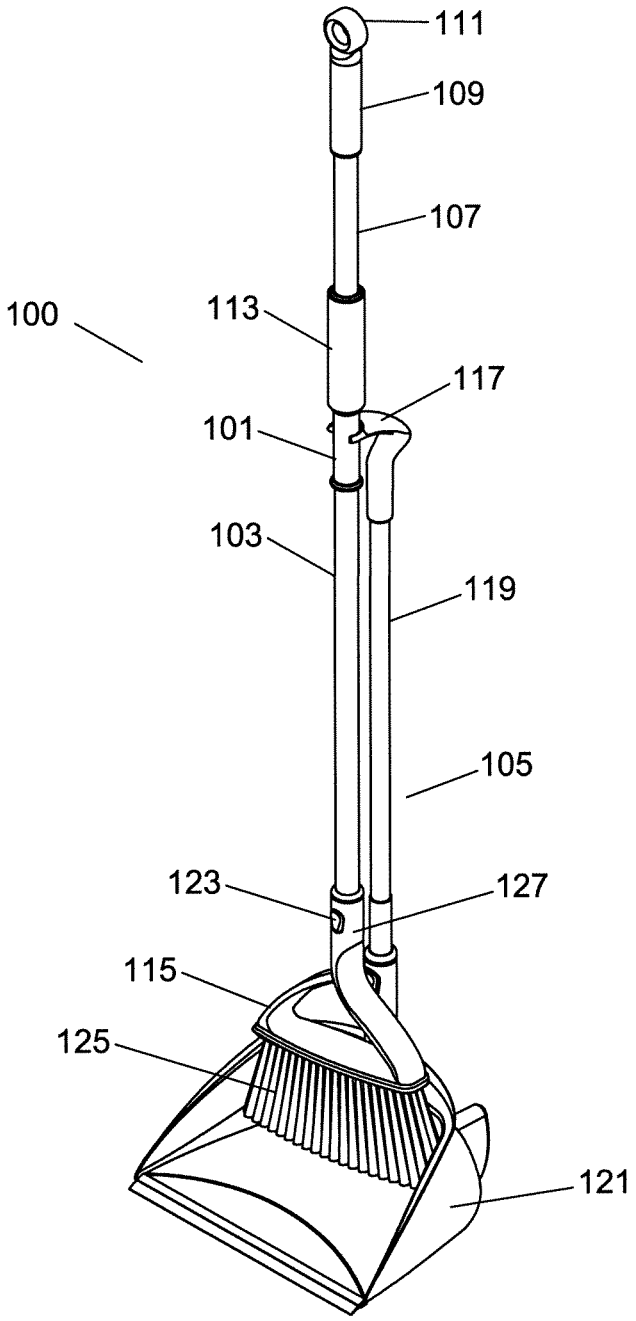
FIG. 1 is a perspective view of the upright sweep set.

The attached figures depict various views of the Upright Sweep Set in sufficient detail to allow one skilled in the art to make and use the present invention. These figures are exemplary, and depict a preferred embodiment; however, it will be understood that there is no intent to limit the invention to the embodiment depicted herein. On the contrary, the intent is to cover all alternatives, modifications, and equivalents as may be included within the spirit and scope of the invention as defined by this specification, claims and drawings.

DESCRIPTION OF THE PREFERRED EMBODIMENTS

An Upright Sweep Set is described and depicted by way of this specification and the attached drawings.

For a general understanding of the present invention, reference is made to the drawings. In the drawings, like reference numerals have been used throughout to designate identical elements.

The Upright Sweep Set comprises a broom and upright dustpan, as will be further described herein.

Referring to FIG. 1, a perspective view of the upright sweep set 100 is shown. The upright sweep set may be made from any suitable rigid or semi-rigid material, for example, a plastic. Examples of suitable plastics include acrylonitrile butadiene styrene (ABS), polyethylene, polypropylene, polystyrene, polyvinyl chloride, polytetrafluoroethylene, and the like. Bioplastics may also be used in some embodiments of the present invention. In addition, reinforced plastics, metals, wood, or other materials that may be suitably formed may also be used, and may in some embodiments be preferred for components such as handles and the like. The various components of the upright sweep set may be made by injection molding, blow molding, machining, extruding, or the like.

The broom 103 can be seen attached to the upright dustpan 105. The broom 103 comprises a cleaning head 115 with a top side and a bottom side (as oriented in FIG. 1 and also as oriented in normal use). The cleaning head 115 is intended to be detachable so that it may function as both a traditional broom as well as a whisk broom or hand broom. In some embodiments of the present invention, the cleaning head 115 has an open handle forming a generally triangular shape. This can be clearly seen in the drawings. Other geometries may also be employed. In some embodiments of the present invention, one or more sides of the cleaning head 115 may comprise a soft durometer material as an overlay or inlay to allow for ease of use while grasping the cleaning head 115 while serving as a whisk or hand broom. A soft durometer material may also be present around the perimeter of the cleaning head 115. In some embodiments of the present invention, one of the triangular sides retains bristles 125, while a second of the triangular sides is rounded and a third of the triangular sides is rectangular or otherwise flat. The bristles 125 may be made from a synthetic material such as nylon or other plastic, or may, in some embodiments of the present invention, be made from a natural fiber.

Figure 10:
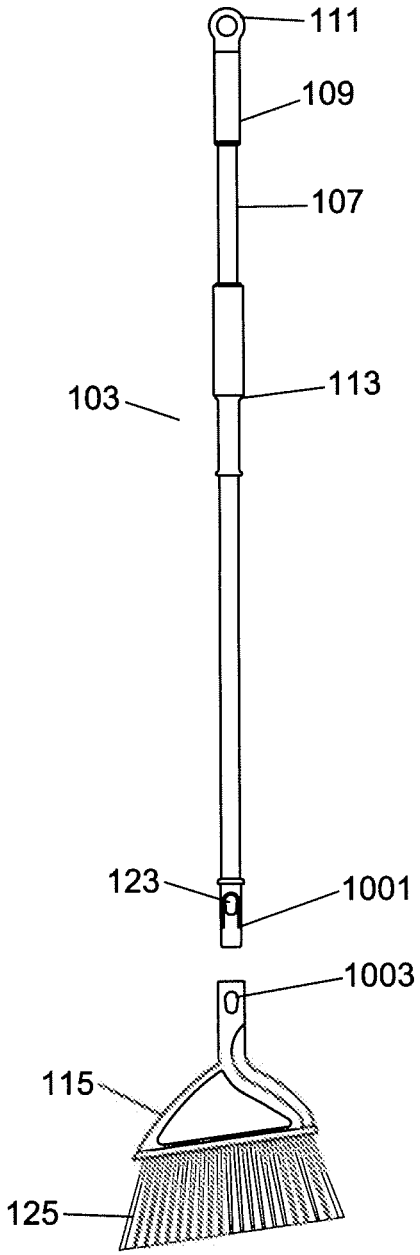
FIG. 10 is a plan view of the broom of the upright sweep set with the handle detached.

The top side of the cleaning head 115 has a cleaning head coupling 127. The cleaning head coupling 127 has a live hinge tab receiver 1003 (see FIG. 10). The tab receiver 1003 as seen in FIG. 10 may, in some embodiments of the present invention, have an oval, rounded or teardrop shape, or may appear as an elliptical or other geometric shape, and is an opening in the cleaning head coupling 127. The broom live hinge tab 123 is complimentary in shape to the tab receiver 1003 and positively engages with the tab receiver 1003 once the broom live hinge tab 123 is received in the tab receiver 1003, serving to provide a detachable cleaning head 115 that can be used as both a broom and a whisk or hand broom. The cleaning head coupling 127 receives the broom handle coupling 1001 (see FIG. 10) for positive retention of one to the other.

The broom handle 107 can be seen with various components attached. The broom handle may be made from a metal, plastic, or the like, and may be attached to a handle coupling 1001 (see FIG. 10) with threads, rivets, friction fittings, screws, indentations, or the like. The broom handle 107 has a retention collar 101 located in the midsection of the broom handle 107. The retention collar 101 is affixed to the broom handle 107 and offers an area along the length of the broom handle 107 where the retention handle 117 of the upright dustpan can be affixed for storage. The retention collar 101 has an upper and a lower flange corresponding to generally upper and lower limits where the broom 103 can be retained by the upright dustpan 105. These upper limits may correspond to, for example, the change in placement height when the upright dustpan 105 is closed or open, as portrayed in the drawings, such as in FIG. 16. The retention collar 101 may be made from a plastic such as polypropylene, ABS, or the like. In some embodiments of the present invention, the retention collar 101 may further comprise a surface texture to facilitate proper retention of the broom 103 by the upright dustpan 105. The retention collar 101 encompasses the broom handle 107, and may be cylindrical or of a similar geometry.

The broom handle 107 may also have at least one grip to provide for secure and comfortable retention by the user. The grips may be a soft durometer material or an overlay. The upper grip 109 may be attached to or otherwise an overlay on an end cap or similar structure. The lower grip 113 may also be, in some embodiments of the present invention, attached to or an overlay on the retention collar 101. In some embodiments of the present invention, a swivel ring 111 may be operatively connected to the upper end of the broom handle 107 to allow for convenient storage, retention of a cleaning rag, or the like.

The upright dustpan 105 comprises a handle 119 and a dustpan 121. The upright dustpan handle 119 may be made from a rigid and sturdy material such as steel, a reinforced plastic, or the like. The upright dustpan handle 119 has a handle coupling that will be more clearly depicted in FIGS. 11-18. The upright dustpan handle coupling 1101 (see FIG. 11). The upright dustpan handle coupling 1101 has a live hinge tab receiver 1501 (see FIG. 15). The tab receiver 1501 as seen in FIG. 15 may, in some embodiments of the present invention, have an oval, rounded or teardrop shape, or may appear as an elliptical or other geometric shape, and is an opening in the upright dustpan coupling 1105. The upright dustpan live hinge tab 1103 is complimentary in shape to the tab receiver 1501 and positively engages with the tab receiver 1501 once the upright dustpan live hinge tab 1103 is received in the tab receiver 1501, serving to provide a detachable dustpan 121 that can be used as both a short handled or a long handled dustpan. The upright dustpan coupling 1105 receives the upright dustpan handle coupling 1101 (see FIG. 11) for positive retention of one to the other. Affixed to the upper end of the upright dustpan handle 119 is a retention handle 117 that has a retention claw 1401 (see FIG. 14). The retention handle 117 may be made of a plastic where the retention claw is forked or otherwise has an opening to receive and retain a broom handle such as the broom handle 107 or the retention collar 101 of the broom handle 107. The retention claw 1401 may be curved or otherwise shaped to retain a generally round handle or related component of a broom.

Figure 2:
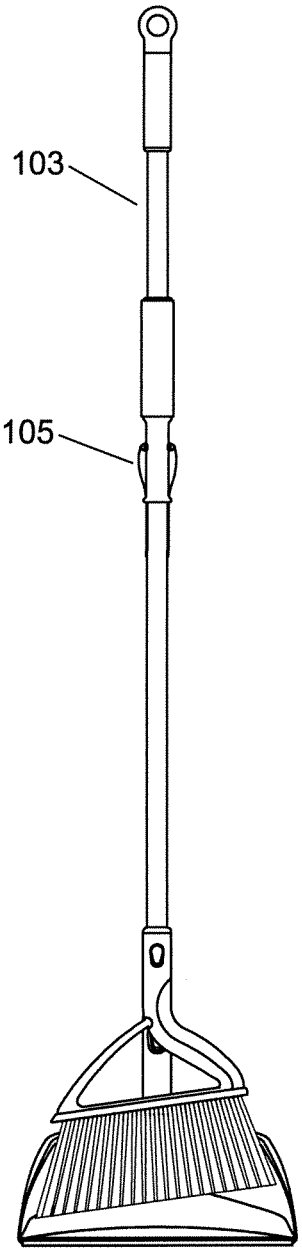
FIG. 2 is a front plan view of the upright sweep set.

FIG. 2 is a front plan view of the upright sweep set showing how the retention handle and related retention claw of the upright dustpan 105 retain the broom 103.

Figure 3:
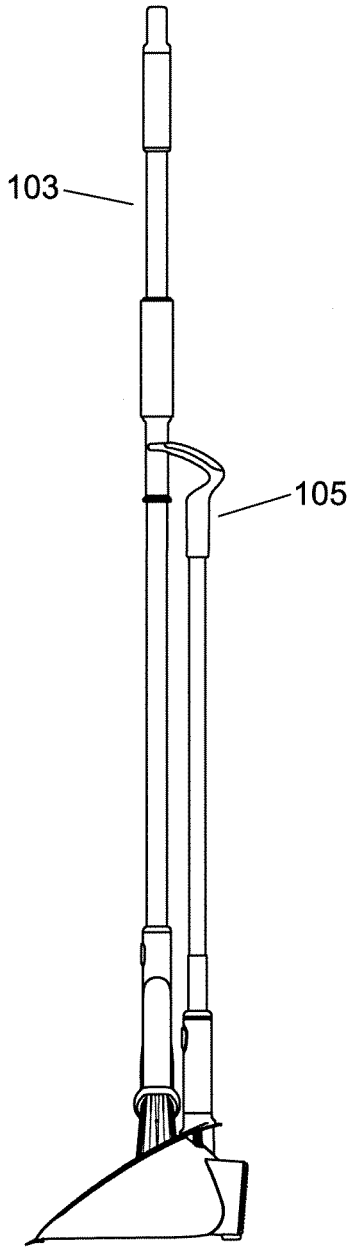
FIG. 3 is a side view of the upright sweep set.
Figure 4:
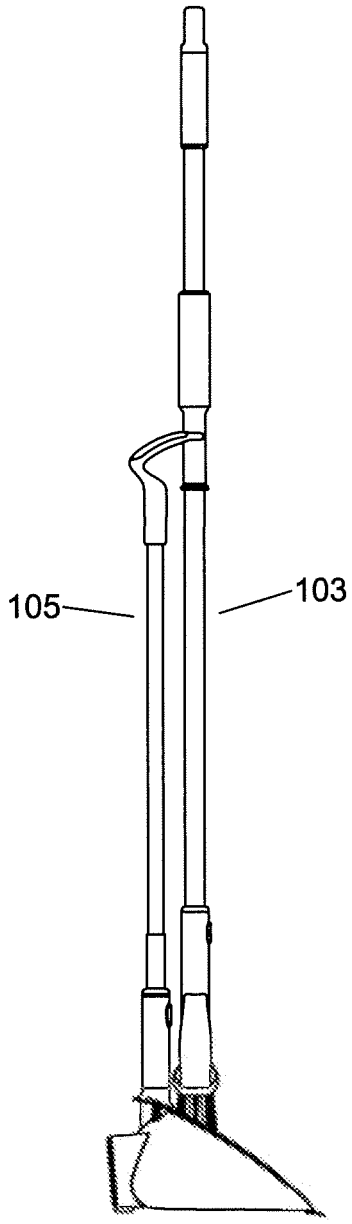
FIG. 4 is an alternate side view of the upright sweep set.
Figure 5:
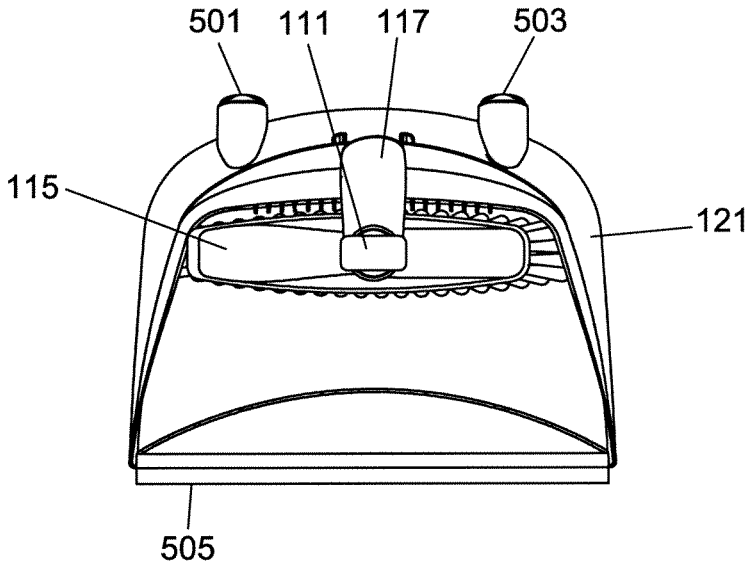
FIG. 5 is a top plan view of the upright sweep set.

FIG. 3 is a side view of the upright sweep set and FIG. 4 is an alternate side view of the upright sweep set. To further depict the broom 103 detached from the upright dustpan 105, FIGS. 7-10 depict the broom 103. FIG. 5 is a top plan view of the upright sweep set showing a pliable edge 505 coupled to the leading edge of the dustpan 121. The pliable edge 505 allows the dustpan to better conform to the floor while in use, resulting in better collection of debris. The pliable edge 505 may be made from a pliable material such as vinyl or the like. Also, to hold the dustpan in an upright and closed position without sliding or otherwise moving, a first grip pad 501 and a second grip pad 503 can be seen. The grip pads comprise a soft durometer material, and may also have additional gripping features such as ridges, grooves, dimples, dots, lines, or the like.

Figure 6:
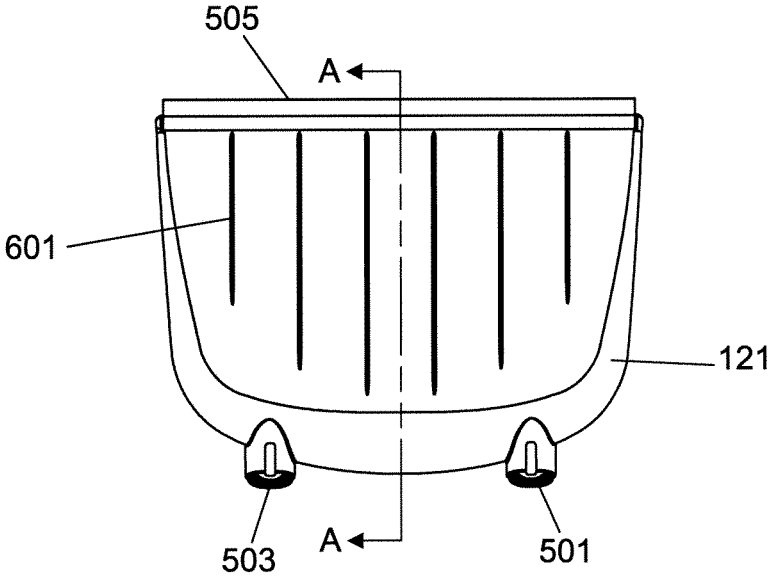
FIG. 6 is a bottom plan view of the upright sweep set.

FIG. 6 is a bottom plan view of the upright sweep set clearly showing the grip pads and pliable edge 505. Also depicted are conformal gussets 601 to add strength to the dustpan and to support a ridge 1403 in the dustpan bottom (see FIG. 14).

Figure 7:
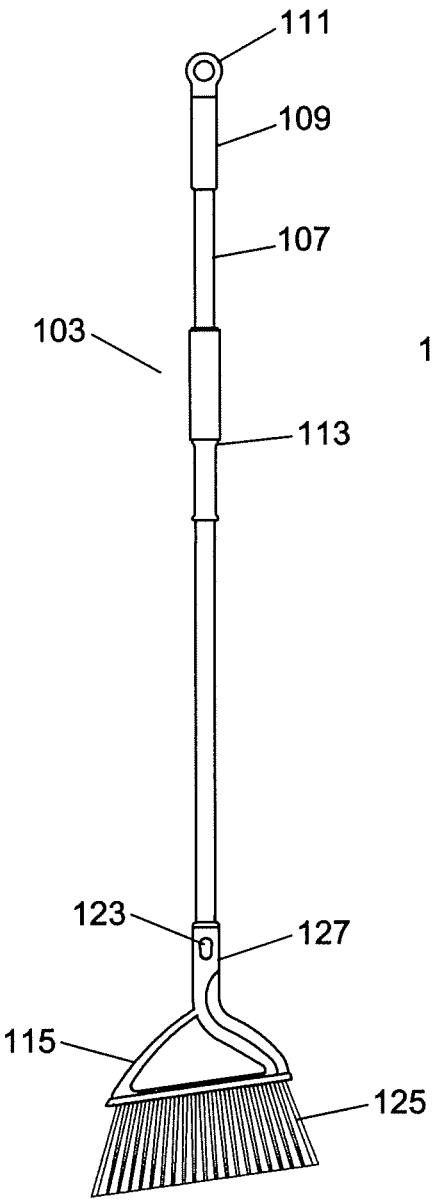
FIG. 7 is a front plan view of the broom of the upright sweep set.

FIG. 7 is a front plan view of the broom 103 of the upright sweep set 100. The cleaning head coupling 127 can be seen as a generally cylindrical form extending from the cleaning head 115 to receive the live hinge tab 123 and related handle coupling and handle.

Figure 8:
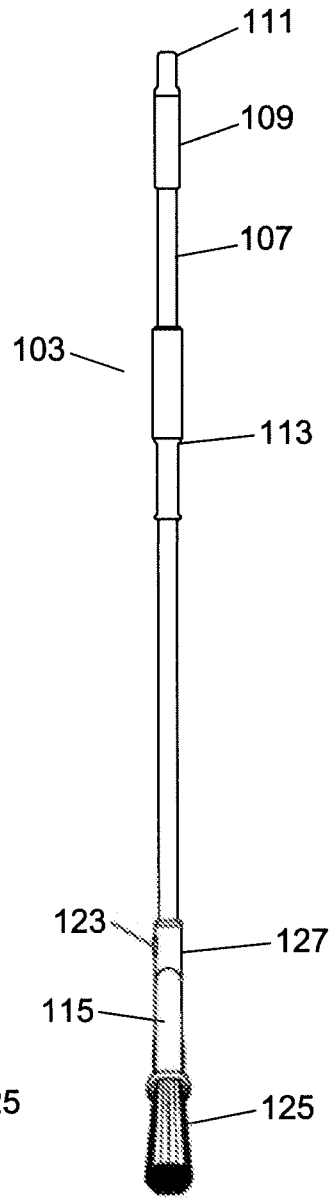
FIG. 8 is a side plan view of the broom of the upright sweep set.
Figure 9:
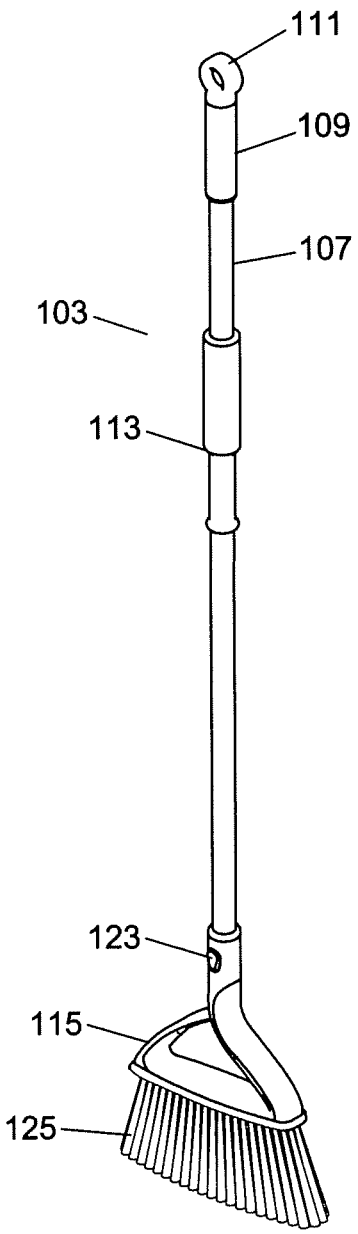
FIG. 9 is a perspective view of the broom of the upright sweep set.

FIG. 8 is a side plan view of the broom 103 of the upright sweep set 100. FIG. 9 is a perspective view of the broom of the upright sweep set.

FIG. 10 is a plan view of the broom of the upright sweep set with the handle detached showing the handle coupling 1001 and the broom live hinge tab 123 affixed to the broom handle 107. As stated previously, the handle coupling 1001 may be made from a variety of plastics, for example. The handle coupling 1001 is generally cylindrical and has a live hinge tab 123. The live hinge tab 123 is formed from the generally cylindrical form and is made as a cut or series of cuts or openings in the generally cylindrical form such that one side remains attached to the generally cylindrical form to create a piece of material that has resiliency and that will hingably move when depressed, returning to its original state when the user stops depressing the live hinge tab 123. The tab that may be round, oval, teardrop shaped, square, rectangular, or other shape, and is affixed to, or built up from, the live hinge structure heretofore described. This live hinge tab releasably engages with an opening in the cleaning head coupling 127 (see FIG. 1) to provide positive retention and coupling of the cleaning head 115 to the handle 107. To use this coupling arrangement, one depresses the live hinge tab 123 and pulls the cleaning head 115 away from the handle 107, thus releasing the cleaning head 115 from the handle 107. To reattach the cleaning head 115 to the handle 107, the live hinge tab 123 is depressed and the cleaning head coupling 127 and associated cleaning head 115 is pushed onto the handle coupling 1001 until the live hinge tab 123 engages with the live hinge tab receiver 1003. In some embodiments of the present invention, the handle coupling 1001 has at least one lateral slit or cut that runs generally parallel to the cylindrical axis of the handle coupling 1001. The purpose of slits or cuts is to allow the handle coupling 1001 to deform and better fit the cleaning head coupling 127.

Figure 11:
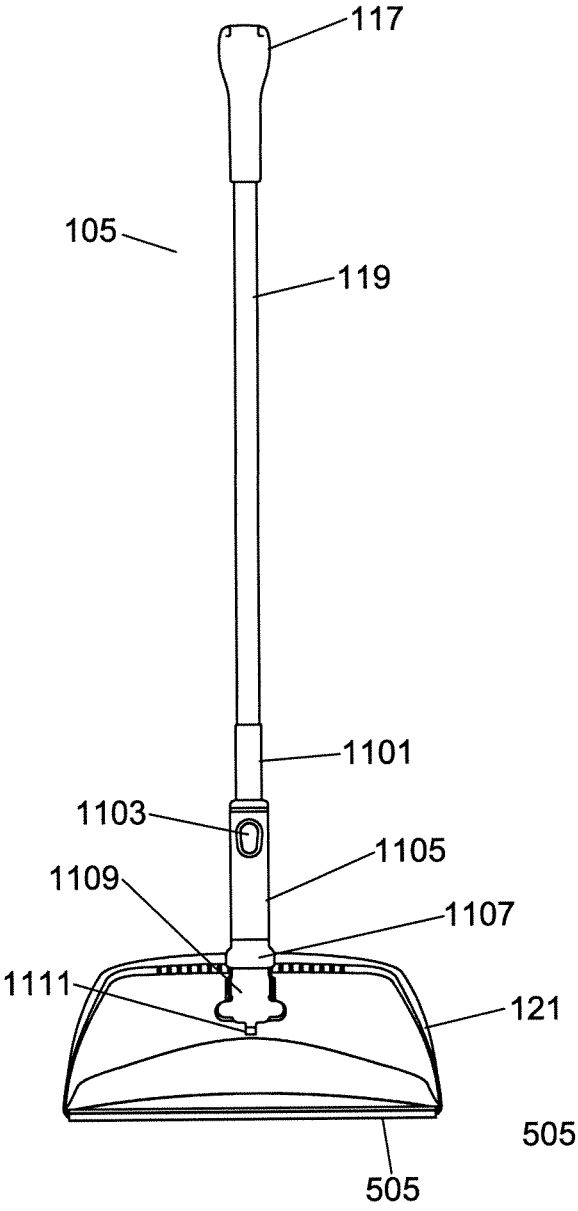
FIG. 11 is a front plan view of the upright dustpan of the upright sweep set.

FIGS. 11-20 depict the upright dustpan 105 in various views. FIG. 11 is a front plan view of the upright dustpan of the upright sweep set. The upright dustpan handle coupling 1101 can be seen with the upright dustpan live hinge tab 1103 engaged in the tab receiver of the upright dustpan coupling 1105. To allow the dustpan to fold from an open to a closed position and back, a novel folding hinge 1109 can be seen, and will be further described by way of FIG. 19. A folding hook catch 1111 can also be seen, and will also be described further by way of FIGS. 17-19.

Figure 12:
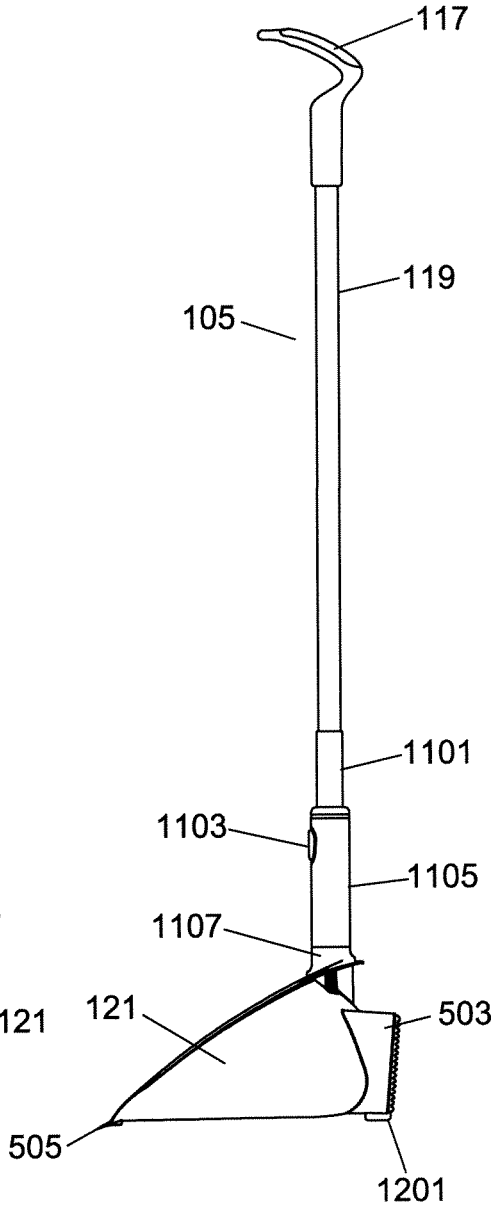
FIG. 12 is a side plan view of the upright dustpan of the upright sweep set.

FIG. 12 is a side plan view of the upright dustpan of the upright sweep set showing the second grip pad 503 (the first grip pad 501 cannot be seen). Accompanying the second grip pad 503 is a grip pad extension 1201 that prevents the dustpan from sliding or otherwise moving while in use. The first grip pad 501 cannot be seen, but also has a grip pad extension similar to the grip pad extension 1201. The grip pad extensions comprise a soft durometer material, and may also have additional gripping features such as ridges, grooves, dimples, dots, lines, or the like.

Figure 13:
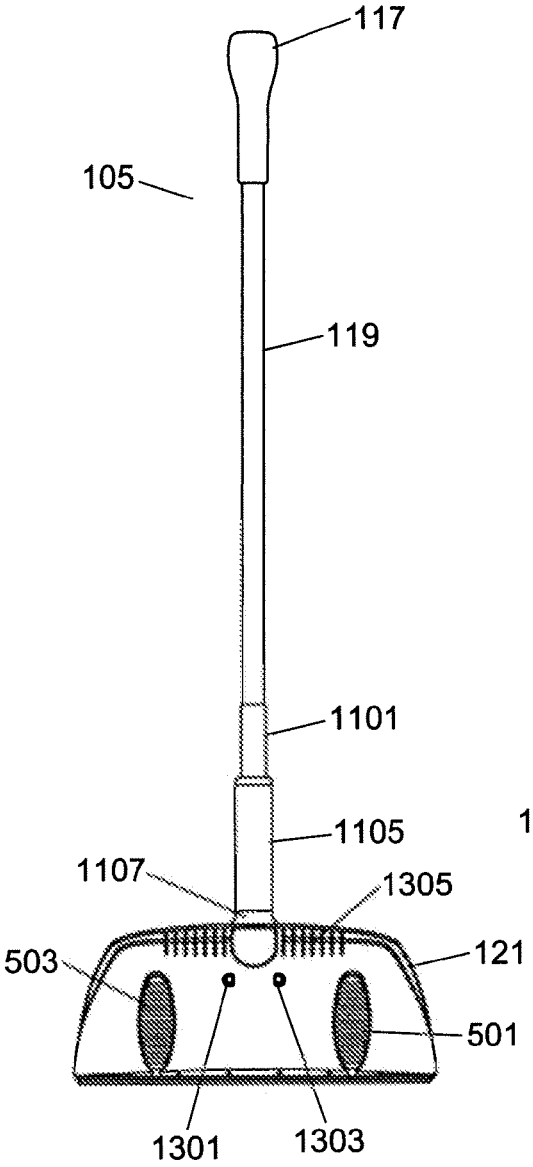
FIG. 13 is a rear plan view of the upright dustpan of the upright sweep set.

FIG. 13 is a rear plan view of the upright dustpan of the upright sweep set showing a first hinge receiver support 1301 and a second hinge receiver support 1303 from the rear of the dustpan. These supports serve to capture and retain hinge pins that are attached to the folding hinge 1109, and will be further described herein. Also depicted in FIG. 13 are pivot support gussets 1305 that serve to retain and reinforce an upper surface of the dustpan with the rear wall of the dustpan in the manner depicted in FIG. 13.

Figure 14:
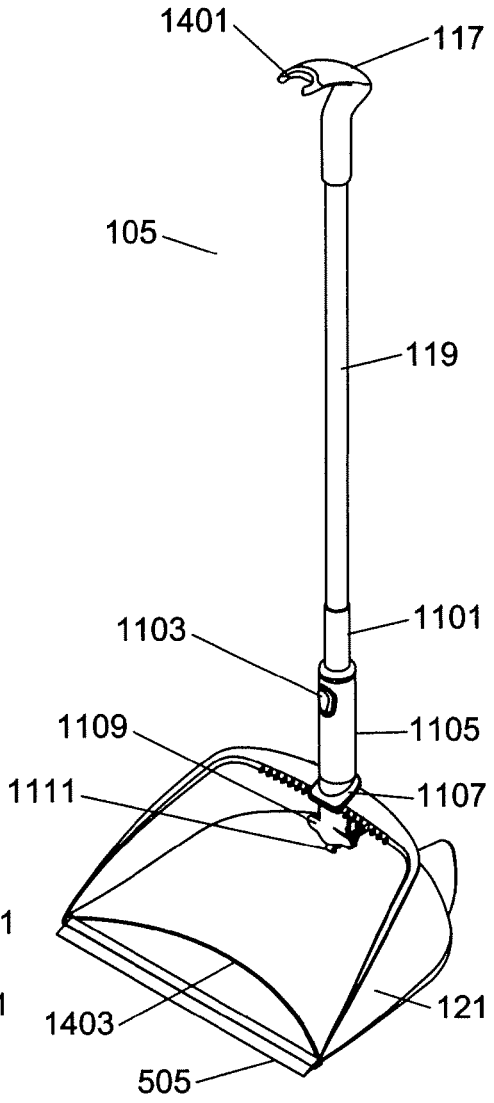
FIG. 14 is a perspective view of the upright dustpan of the upright sweep set.
Figure 15:
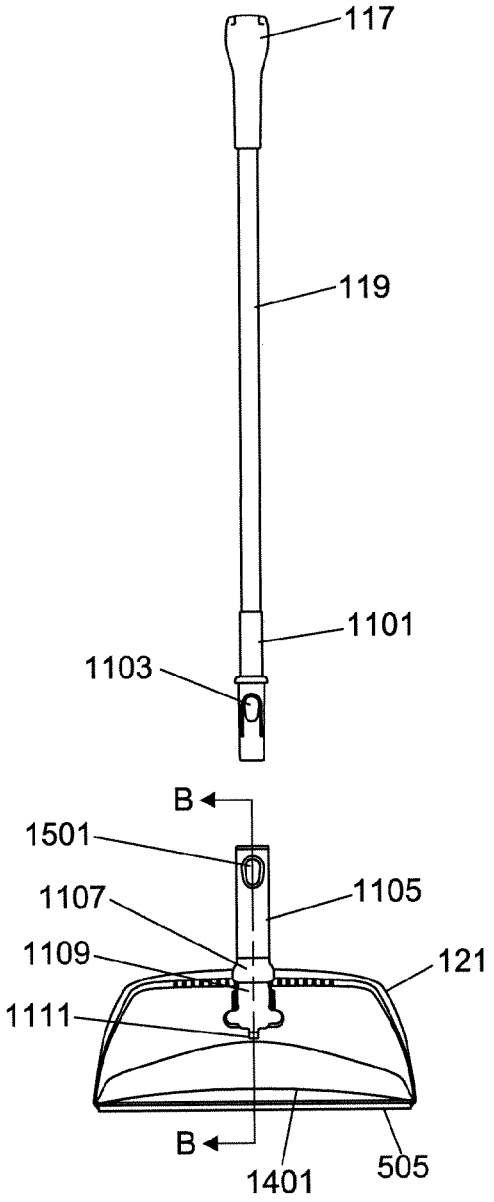
FIG. 15 is a front plan view of the upright dustpan of the upright sweep set with the handle detached.

FIG. 14 is a perspective view of the upright dustpan of the upright sweep set. The retention claw 1401 can be seen as part of the retention handle 117. The retention claw comprises two forks or prongs that form a semi-circular opening for retention of the broom handle 107. In some embodiments of the present invention, the upper surface of the retention handle 117 comprises a soft durometer material. Also seen in FIG. 14 is a ridge 1403 that facilitates retention of debris. In some embodiments of the present invention, the ridge 1403 is semi-circular.

FIG. 15 is a front plan view of the upright dustpan of the upright sweep set with the handle detached. The upright dustpan handle coupling 1101 can be seen along with the upright dustpan coupling 1105. FIG. 15 shows the upright dustpan handle coupling 1101 and the upright dustpan live hinge tab 1103 affixed to the upright dustpan handle 119. The handle coupling 1101 may be made from a variety of plastics, for example. The handle coupling 1101 is generally cylindrical and has a live hinge tab 1103. The live hinge tab 1103 is formed from the generally cylindrical form and is made as a cut or series of cuts or openings in the generally cylindrical form such that one side remains attached to the generally cylindrical form to create a piece of material that has resiliency and that will hingably move when depressed, returning to its original state when the user stops depressing the live hinge tab 1103. The tab that may be round, oval, teardrop shaped, square, rectangular, or other shape and is affixed to, or built up from, the live hinge structure heretofore described. This live hinge tab releasably engages with an opening in the upright dustpan coupling 1105 to provide positive retention and coupling of the dustpan 121 to the handle 119. To use this coupling arrangement, one depresses the live hinge tab 1103 and pulls the dustpan 121 away from the handle 119, thus releasing the dustpan 121 from the handle 119. To reattach the dustpan 121 to the handle 119, the live hinge tab 1103 is depressed and the upright dustpan coupling 1105 and associated dustpan 121 is pushed onto the handle coupling 1101 until the live hinge tab 1103 engages with the live hinge tab receiver 1501. In some embodiments of the present invention, the handle coupling 1101 has at least one lateral slit or cut that runs generally parallel to the cylindrical axis of the handle coupling 1101. The purpose of slits or cuts is to allow the handle coupling 1101 to deform and better fit the upright dustpan coupling 1105.

Figure 16:
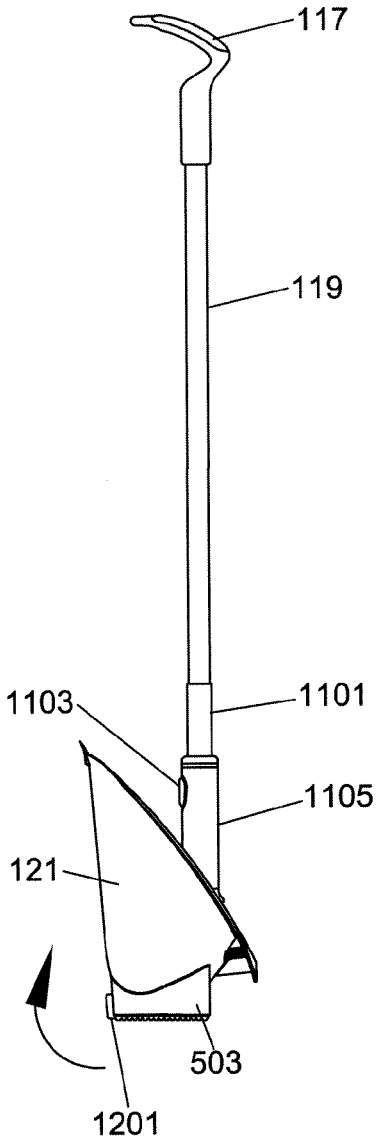
FIG. 16 is a side plan view of the upright dustpan of the upright sweep set with the dustpan in the closed position.

FIG. 16 is a side plan view of the upright dustpan of the upright sweep set with the dustpan in the closed position. The arrow displayed in FIG. 16 illustrates the direction of motion when the dustpan travels from an open position to a closed position.

Figure 17:
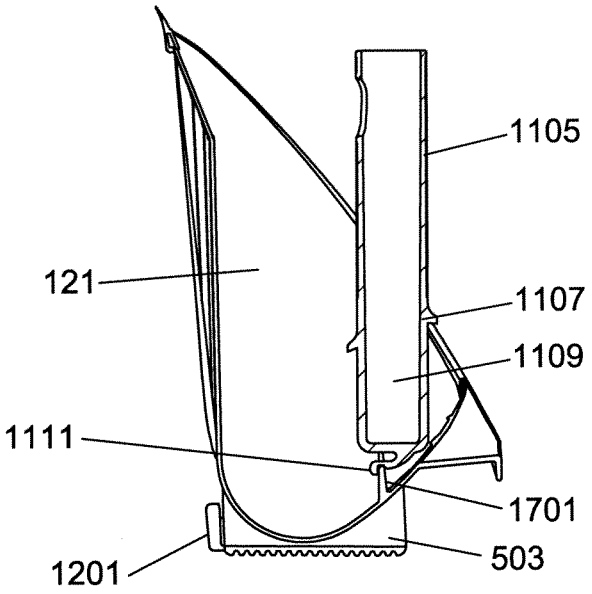
FIG. 17 is a cross sectional view of the dustpan in the closed position taken along line A-A of FIG. 6.

FIG. 17 is a cross sectional view of the dustpan in the closed position taken along line A-A of FIG. 6. The folding hinge 1109 can be clearly seen attached to the dustpan 121. As the folding hinge causes the dustpan to move from an open to a closed position or from a closed position to an open position, a folding hook catch 1111 that is attached to the lower end of the folding hinge 1109 engages with a folding hook catch retainer 1701 to maintain the upright dustpan in the closed position. The folding hook catch retainer 1701 is a lip, edge, or other geometry that allows the curved end of the folding hook catch 1111 to grasp the edge or lip. The folding hook catch 1111 has a curve to allow the resilient plastic from which it is made to create a force that is sufficient to retain the dustpan in the closed position, but that can be easily overcome by a user who wishes to move the dustpan to the open position.

Figure 18:
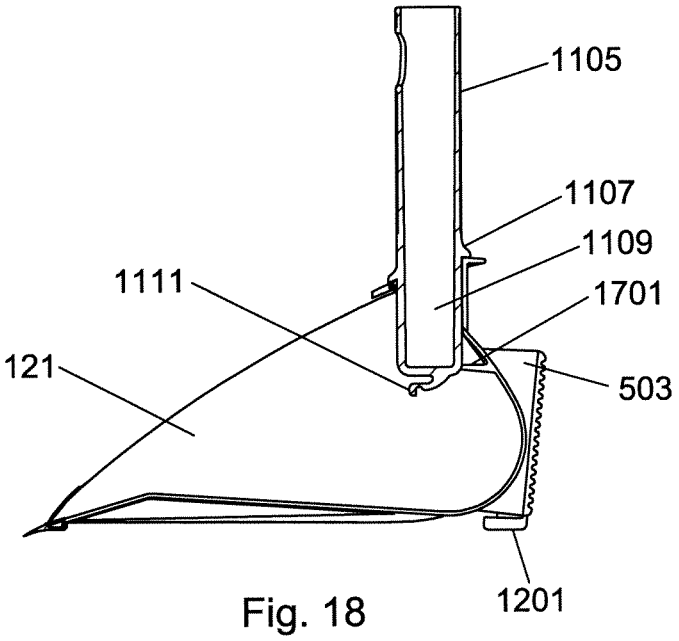
FIG. 18 is a cross sectional view of the dustpan in the open position taken along line B-B of FIG. 15.

FIG. 18 is a cross sectional view of the dustpan in the open position taken along line B-B of FIG. 15. The folding hook catch 1111 has been freed from the edge or lip of the folding hook catch retainer 1701 to allow the upright dustpan to be in the open position. Also seen in both FIGS. 17 and 18 is the folding hinge flange 1107 that engages with an upper surface of the dustpan, as seen in FIG. 18.

Figure 19:
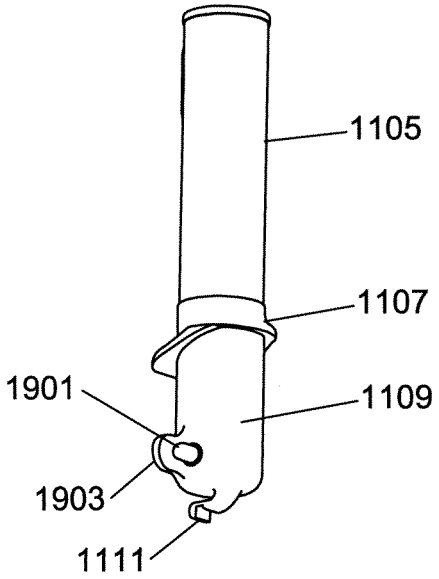
FIG. 19 is a perspective view of the upright dustpan coupling.
Figure 20:
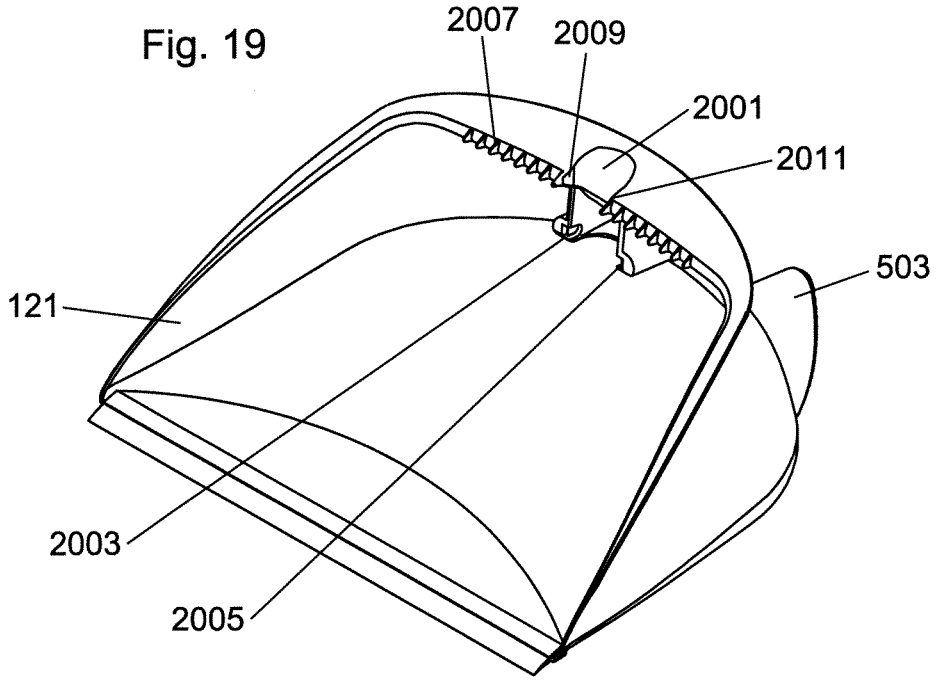
FIG. 20 is a perspective view of the dustpan without the coupling or handle.

FIG. 19 is a perspective view of the upright dustpan coupling 1105 and folding hinge 1109. To hingably engage with the dustpan, a first hinge pin 1901 and a second hinge pin (not seen from this perspective, but the part has bilateral symmetry so the second hinge pin is essentially the same as the first hinge pin 1901) are employed and are molded with, or attached to, the folding hinge 1109. The folding hinge 1109 further comprises a retention ear 1903 attached to the folding hinge 1109. The hinge pins engage with hinge pin receivers, as seen in FIG. 20. A first hinge pin receiver 2003 and a second hinge pin receiver 2005 can be seen in FIG. 20, and are a negative of the geometry of the hinge pins, allowing for ease of rotational movement of the folding hinge 1109 with respect to the dustpan 121. FIG. 20 is thus a perspective view of the dustpan without the coupling or handle. A folding hinge receiver 2001 can be seen that conforms to and receives the folding hinge 1109 and associated upright dustpan coupling 1105. In some embodiments of the present invention, the upright dustpan coupling 1105 has a soft durometer material overlaid or inlaid on the coupling to facilitate a slip resistant grip when using the cleaning head as a whisk or hand broom. The folding hinge receiver 2001 comprises semi-circular walls for receiving the folding hinge 1109 and associated upright dustpan coupling 1105 and handle 119 (see FIG. 1). To releasably retain the folding hinge and associated upright dustpan coupling 1105, a first friction pad 2009 and a second friction pad 2011 are employed, and are a built up piece of material that protrudes at the opening of the folding hinge receiver to create a tight fit and associated retention thereof. The friction pads may be made from the same material as the dustpan, or may be added to the dustpan as a secondary operation. In some embodiments of the present invention, cleaning spikes 2007 are attached to an upper surface of the dustpan 121.

To use the upright sweep set, the broom can be used separately for various cleaning operations. The upright dustpan can then be used to capture and retain debris swept into it using the broom. The cleaning head of the broom can also be removed for use as a hand or whisk broom. In addition, the handle of the upright dustpan can be removed for use of the dustpan with a long or short handle. The upright dustpan can be folded or closed as previously described herein. The handle of the upright dustpan can be moved to close the dustpan as shown in FIG. 16 to allow for storage, or to close the dustpan while transporting debris to be disposed of. The various novel aspects of the upright sweep set add to ease of use and convenience while providing a highly useful cleaning device.

It is, therefore, apparent that there has been provided, in accordance with the various objects of the present invention, an upright sweep set. While the various objects of this invention have been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of this specification, claims and the attached drawings.

What is claimed is:

1. An upright sweep set comprising:

a broom comprising a cleaning head with a top side and a bottom side, the top side comprising a cleaning head coupling with a live hinge tab receiver and the bottom side comprising bristles; a broom handle comprising a retention collar, at least one grip, and a live hinge tab for removably coupling the broom handle to the cleaning head; and an upright dustpan comprising a handle having a retention claw for removably attaching to the retention collar of the broom, a handle coupling with a live hinge tab receiver for removably coupling the handle to a dustpan that has a live hinge tab, and a folding hinge between the handle and the dustpan where the folding hinge comprises a hinge pin and a folding hook catch for releasably engaging with a folding hook catch retainer attached to the dustpan.

2. The upright sweep set of claim 1, wherein the broom further comprises an upper grip and a lower grip attached to the broom handle.

3. The upright sweep set of claim 1, wherein the broom further comprises a swivel ring attached to the broom handle.

4. The upright sweep set of claim 1, wherein the cleaning head of the broom has an open handle.

5. The upright sweep set of claim 4, wherein the cleaning head of the broom has an open handle forming a generally triangular shape.

6. The upright sweep set of claim 1, wherein the upright dustpan further comprises a first grip pad and a second grip pad affixed to the bottom of the dustpan to prevent movement of the dustpan during use.

7. The upright sweep set of claim 1, wherein the dustpan further comprises a pliable edge affixed to the bottom of the dustpan to allow the dustpan to conform to the floor while in use.

8. The upright sweep set of claim 1, wherein the dustpan further comprises conformal gussets located along the underside of the dustpan to support a ridge in the bottom of the dustpan.

9. The upright sweep set of claim 8, wherein the ridge is semi-circular.

10. The upright sweep set of claim 1, wherein the folding hinge further comprises a folding hinge flange for releasably engaging with an upper surface of the dustpan.

11. The upright sweep set of claim 1, wherein the folding hinge further comprises a retention ear attached to the folding hinge.

12. The upright sweep set of claim 1, further comprising a grip pad.

13. The upright sweep set of claim 1, wherein the dustpan further comprises a folding hinge receiver having a first friction pad and a second friction pad for releasably retaining the folding hinge.

14. The upright sweep set of claim 13, wherein the folding hinge receiver comprises semi-circular walls for receiving the folding hinge and upright dustpan handle.

15. The upright sweep set of claim 1, further comprising cleaning spikes attached to an upper surface of the dustpan.

* * * * *